United States Patent [19]

Mente et al.

[11] Patent Number: 5,045,271

[45] Date of Patent: Sep. 3, 1991

[54] PROCESS FOR THE PRODUCTION OF IRREGULAR NON-WOVEN MATERIAL SHEETS

[75] Inventors: Kurt Mente, Hanover; Gerhard Knitsch, Wedemark, both of Fed. Rep. of Germany

[73] Assignees: J. H. Benecke GmbH, Hanover; Corovin GmbH, Peine, both of Fed. Rep. of Germany

[21] Appl. No.: 373,658

[22] Filed: Jun. 28, 1989

Related U.S. Application Data

[63] Continuation of Ser. No. 937,298, Dec. 3, 1986, abandoned.

[30] Foreign Application Priority Data

Jan. 17, 1986 [DE] Fed. Rep. of Germany ..... 3601201

[51] Int. Cl.[5] ..... D04H 3/00

[52] U.S. Cl. ..... 264/555; 264/103; 264/210.8; 264/211.14; 19/299

[58] Field of Search ..... 65/5; 425/72.2, 66, 425/80.1, 83.1; 19/299, 296; 28/172 A, 178; 264/555, 103, 210.8, 211.14

[56] References Cited

U.S. PATENT DOCUMENTS

| | | | |
|---|---|---|---|
| 3,509,009 | 4/1970 | Hartmann | 161/150 |
| 3,698,610 | 10/1972 | Feltgen et al. | 19/299 |
| 3,836,346 | 9/1974 | Stalego | 65/1 |
| 3,929,542 | 12/1975 | Gehrig et al. | 425/72.2 |
| 3,970,417 | 7/1976 | Page | 425/725 |
| 4,064,605 | 12/1977 | Akiyama et al. | 28/103 |
| 4,202,855 | 5/1980 | Gerking et al. | 264/210.2 |
| 4,300,876 | 11/1981 | Kane et al. | 425/72.2 |
| 4,316,731 | 2/1982 | Lin et al. | 65/5 |
| 4,334,340 | 6/1982 | Reba | 425/72.2 |
| 4,340,563 | 7/1982 | Appel et al. | 425/72.2 |
| 4,405,297 | 9/1983 | Appel et al. | 425/72.2 |
| 4,600,423 | 7/1986 | Stotler et al. | 65/5 |
| 4,637,104 | 1/1987 | Mente | 28/283 |

FOREIGN PATENT DOCUMENTS

| | | | |
|---|---|---|---|
| 1760713 | 4/1972 | Fed. Rep. of Germany . | |
| 1785158 | 7/1972 | Fed. Rep. of Germany . | |
| 1303569 | 8/1974 | Fed. Rep. of Germany . | |
| 405220 | 7/1977 | Fed. Rep. of Germany . | |
| 1950669 | 5/1982 | Fed. Rep. of Germany . | |
| 2421401 | 12/1982 | Fed. Rep. of Germany . | |
| 3406346 | 10/1984 | Fed. Rep. of Germany . | |
| 1492400 | 12/1967 | France . | |
| 49-23259 | 6/1974 | Japan | 19/299 |
| 928865 | 10/1961 | United Kingdom . | |
| 1282176 | 7/1972 | United Kingdom . | |
| 1297582 | 11/1972 | United Kingdom . | |

OTHER PUBLICATIONS

"Truckenbrodt" Stromungsmechanik, 1968, pp. 7–9.

Chemie—Ing.—Techn. 42 Jahrg. 1970/Nr. 6, p. 401.

*Primary Examiner*—Hubert C. Lorin

*Attorney, Agent, or Firm*—Cushman, Darby & Cushman

[57] ABSTRACT

In the production of irregular non-woven material sheets of synthetic filaments, the warp from spinnerets is drawn off by means of a draw-off device and then deposited on a substrate. To avoid tangling of the individual filaments, they are guided along a nozzle wall formed by slot nozzles stacked on top of each other and forming a draw-off device. The slot nozzles as well as the air compressor are operated polytropically. The deposit of the warp on the substrate is accomplished by a flip-flop cross winding.

7 Claims, 4 Drawing Sheets

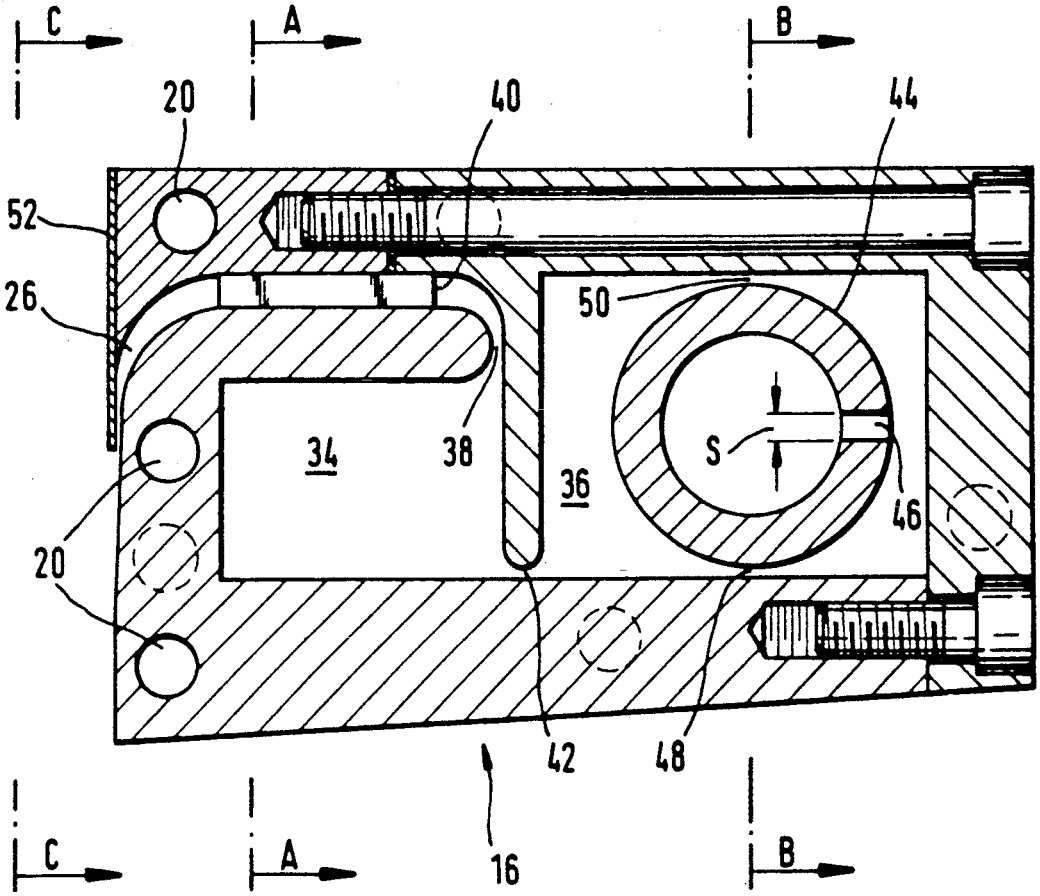
FIG. 3
FIG. 4
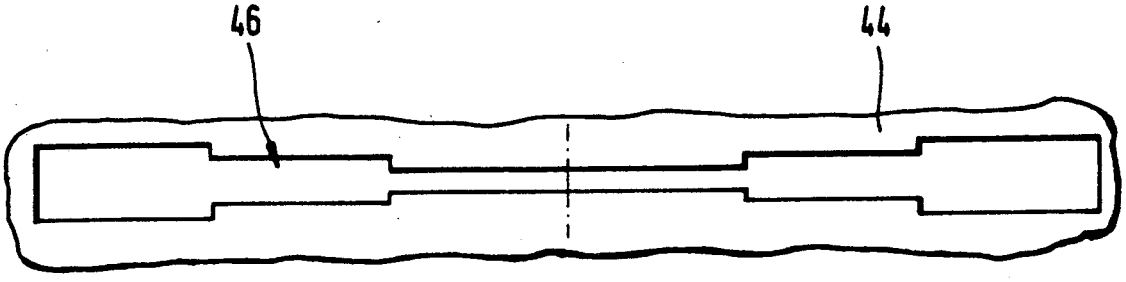

PROCESS FOR THE PRODUCTION OF IRREGULAR NON-WOVEN MATERIAL SHEETS

This is a continuation of application Ser. No. 06/937,298, filed Dec. 3, 1986, which was abandoned upon the filing hereof.

BACKGROUND OF THE INVENTION

The invention relates to a process for the production of irregular non-woven material sheets which are drawn off in the form of a warp from spinnerets by means of a gaseous propellant generated by a compressor or the like and are deposited on a substrate. Furthermore, the invention relates to an apparatus for carrying out the process.

processes and apparatus of the above presupposed species are already known from German patent 1 785 158, British patent 1 282 176 and British patent 1 297 582. A common characteristic of these processes is that the warp is drawn off the spinnerets under the influence of compressed air by means of a filament draw-off device and, after passing through a spreading device, is deposited on the substrate in order to form an irregular non-woven material sheet.

An important aspect during the production of non-woven material sheets is the filament draw-off force occurring in the filament draw-off device which, in the known processes and apparatus, is mainly created inside a filament offlet having at its upper end a filament draw-off nozzle supplied with highly compressed air.

In practical use it has been shown that, although a sufficient filament draw-off force can be generated with the filament offlets, the filament offlets have, however, a disadvantage in another way. It is possible that within the narrow filament offlets—the inner diameter is, for example—around 3 mm—the individual filaments can become tangled, which has the troublesome result that the structure of the irregular non-woven material sheets is not uniform. However a definite characteristic of the quality of an irregular non-woven material sheet is as uniform a structure as possible.

This is where the invention comes into play, by means of which a process and an apparatus is to be created which permit the production of irregular non-woven material sheets with as uniform a structure as possible.

SUMMARY OF THE INVENTION

To achieve its goals, the invention takes an entirely novel approach leading away from the customarily used filament offlets and, instead, making it possible to draw off and guide the warp along a wall area or nozzle wall composed of several slot nozzles. Since this way no bundling takes place within the filament offlets, the danger of tangling of several filaments has been removed, so that irregular non-woven material sheets with a uniform structure can be made.

The invention is based on the realization proven by tests, that the necessary filament draw-off forces of approximately 0.2N (measured for comparison purposes on a copper wire of 0.12 mm diameter) can be created with several stacked slot nozzles. In this regard a disposition, in which the air exits the slot nozzles at an angle of approximately 15° or less—in relation to the direction of the movement of the filaments—has been proven practical, creating a strong power component acting as drawing force in the direction of the movement of the filaments.

A further important characteristic of the invention consists in the novel utilization of an adiabatic or polytropic process, while the known processes operate isothermically. The invention proceeds from the realization, mathematically derived further on, that in an adiabatic process (among other reasons because of the higher viscosity of the air at higher temperatures) higher filament draw-off forces can be achieved than in the isothermic process, which is an advantage in the sense of the efficiency of the novel process. In contrast to the isothermal process, no condensation moisture is created, for which reason the sticking together of the warps is advantageously avoided.

In a practical embodiment of the invention the admission pressure of the slot nozzles is set somewhat higher than the critical pressure (the ratio of the admission pressure to the ambient pressure therefore is greater than the Laval pressure ratio). The expansion of the air stream occurring at the exit of the slot nozzles advantageously lifts the warp manner by a small amount from the flat nozzle wall so that in this respect there is also no danger of tangling or sticking to the nozzle wall.

In accordance with the thermodynamic laws the compressed air heats up to more than 350 K, and during the expansion at the exit of the slot nozzle approximately ambient room temperature is reached again, while the slot nozzle itself heats up considerably, possibly leading to a danger of the filaments sticking to the nozzle wall. For this reason, cooling in the front part of the slot nozzles is provided in a practical embodiment of the invention in the form of bores through which, for example, water is pumped.

Although a process for the production of an irregular non-woven material sheet of synthetic filaments guided along a wall is known from German laid-open publication DE-OS 1 760 713, only one slot nozzle serving as draw-off device is provided there. In an expensive and disadvantageous manner, special spacers are provided to keep the warp at a distance from the walls and, furthermore, no adiabatic or polytropic process is provided in the known method. Finally, the working of this known process requires an additional adjustable plate located opposite the wall, which leads to extra expense.

Furthermore, in Swiss published publication CH-DS 405 220 there is already described a method for producing flat fiber bodies where warps are guided through assigned closed channels which are used for guidance and cooling of the warps, while the actual filament draw-off forces are created by two slots supplied with air and located immediately below the spinneret. Within the channnels secondary air is introduced via obliquely disposed slots, so that the several warps are completely solidified after leaving the assigned channels and can be deposited in turn, by which a multi-surface filament body is created. So that, if possible, all filaments can be captured by the air flow, the spinnerets are shaped comparatively narrow, so that the production rate of the known process is correspondingly small. The use of an adiabatic or polytropic process is not mentioned there.

In order to further increase the desired uniform structure of the irregular non-woven material sheet of the invention, a so-called flip-flop cross winding has been provided in a practical embodiment, known per se from German patent 24 21 401, which guarantees an especially great uniformity of the structure in combination with the novel nozzle wall.

Further advantageous improvements of the invention are disclosed in the sub-claims and are shown in the drawings.

The invention is further explained below by means of the exemplary embodiments shown in the drawings.

BRIEF DESCRIPTION OF THE DRAWINGS

FIG. 3 is a cross-sectional view of a slot nozzle with a supply tube, FIG. 4 shows the different slot widths of a slot in a supply tube.

DETAILED DESCRIPTION

Figure 1:
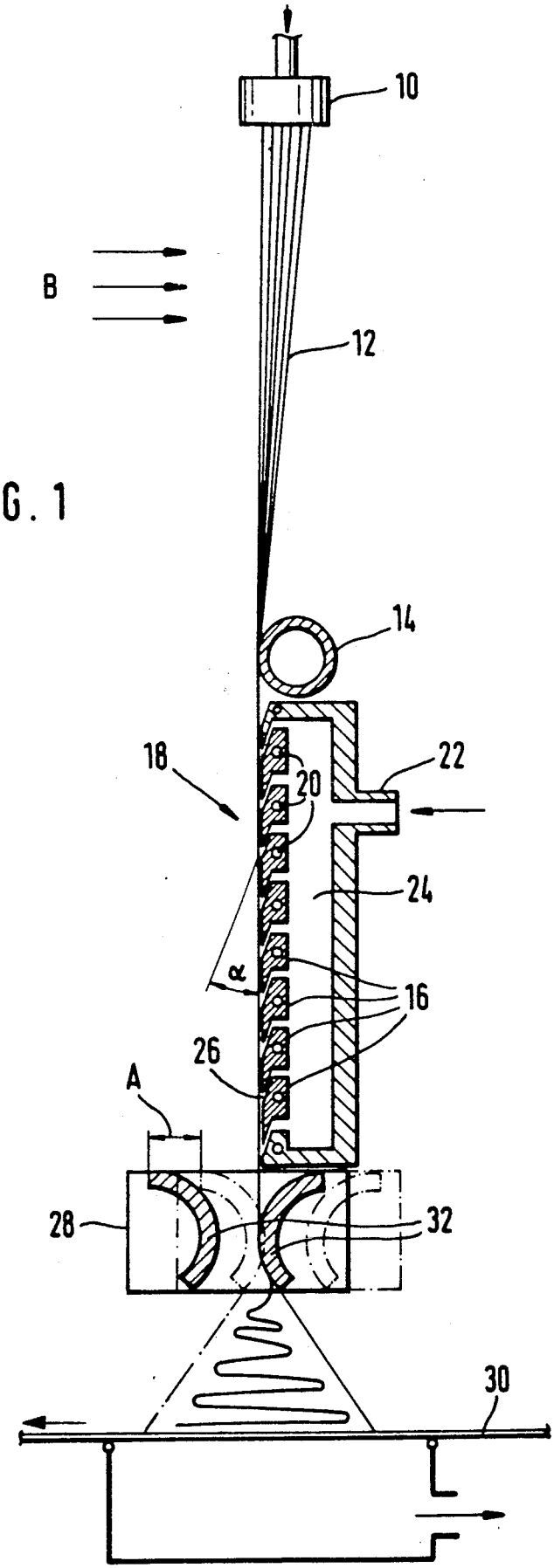
FIG. 1 is a schematic cross-sectional view to show the principle of an apparatus according to the invention.

In FIG. 1, synthetic filaments 12 are drawn off spinnerets in the form of a warp 10 by means of a downwardly directed stream of air, which is generated by slot nozzles 16 stacked atop each other, forming a wall of nozzles 18. By means of a transverse stream of air, indicated by arrows B, the filaments 12 exiting from the spinnerets are cooled to room temperature and the filaments 12 are aligned by a horizontally adjustable tube 14.

By means of an air compressor, not shown, which is operated adiabatically or polytropically—for example, a single stage turbo compressor—air reaches the nozzle chamber 24 via the feed 22. The exit slots 26 of the slot nozzles extend at an angle of about 15°, so that a downwardly directed air flow is created into which the aligned filaments 12 dip at the angle mentioned.

Figure 2:
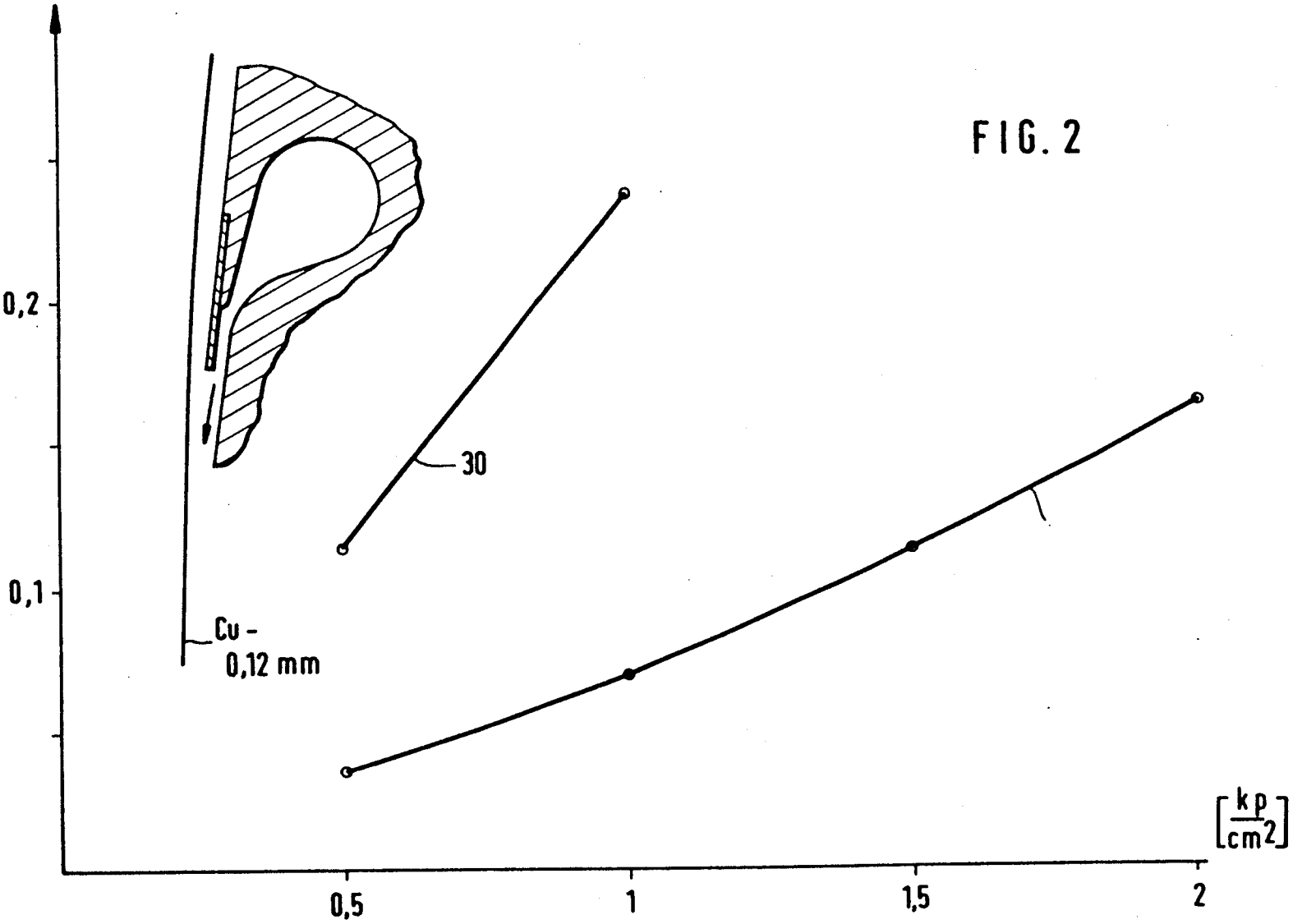
FIG. 2 is a diagram showing the filament draw-off forces.
Figure 6:
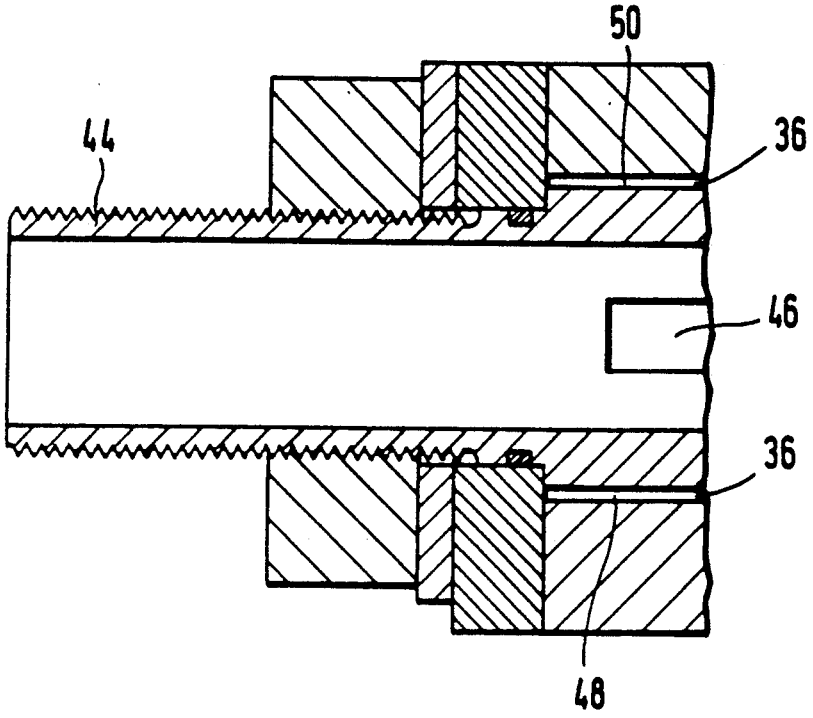
FIG. 6 is a cross-sectional view along the section line B—B of FIG. 3.
Figure 5:
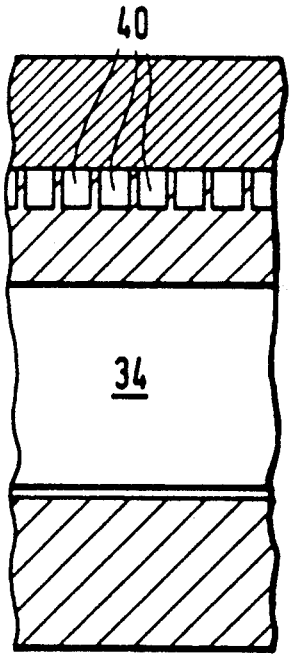
FIG. 5 is a cross-sectional view along the section line A—A of FIG. 3.
Figure 7:
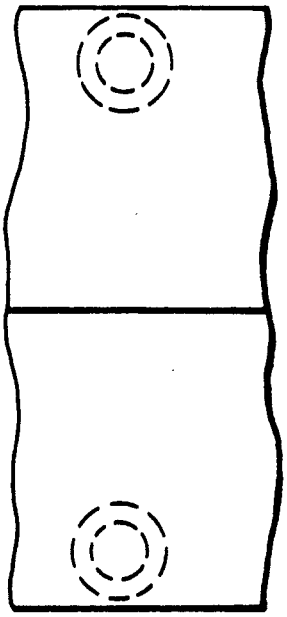
FIG. 7 is a cross-sectional view along the section line C—C of FIG. 3.

The air exiting at the speed of sound exerts a pulling force having an exactly determined value in order to achieve the desired filament titre on the filaments 12. By means of a test arrangement with a copper wire of 0.12 mm diameter it was possible to measure and determine that for the production of a polypropylene non-woven material (pp) with a filament titre of 2 dtex (1 dtex=thickness of a filament of a weight of 1 g and a length of 10,000 m) a draw-off force of 0.2N is required The results of the measuring are shown in FIG. 2—together with a schematic arrangement of the test lay-out—. As can be seen, the filament draw-off force of 0.2N can be achieved easily with thirty stacked slot nozzles, while with the use of only one slot nozzle a sufficient filament draw-off force could not be achieved, even when increasing the compressed air pressure.

The compressor as well as the slot nozzles 16 are operated polytropically. The compressor compresses the air from the ambient state polytropically to or higher than the critical pressure of 1.894 bar. In order to achieve as complete a use of the energy as well as the adiabatic process, the compressor, the supply lines and the backs of the slot nozzles are insulated.

Although the compressed air has reached a relatively high temperature of to more than 350 K, approximately room temperature is reached again at the exit of the slot nozzles 16 when the air is expanded and the pressure of the air decreased, but the slot nozzles 16 heat up so that there can be danger of the filaments 12 sticking to the nozzle wall 18. For this reason bores 20 for water cooling are provided at the front end of the slot nozzles 16 in order to draw off the heat.

After passing the nozzle wall 18, i.e. the slot nozzles 16, the filaments reach a spreading device 28 and are then deposited on a screen conveyor 30 in the form of a uniformly distributed non-woven material sheet. The spreading device 28 comprises two spaced apart oscillating Coanda shells 32 and is further described in German patent 24 21 401, so that there is no need to further discuss this here.

For a better understanding of the novel process based on an adiabatic process and the effect thereof on the filament draw-off force, the appropriate mathematical relationships are further discussed below. It is known (Mayer, "Berechnung der Schubspannung und Wärmeübergang an längsangeströmten Fäden", Chem-Ing.-Technik, 42. Jahrgang 1970, Nr. 6, Seite 401; Hamana et al "Der Verlauf der Fadenbildung beim Fadenspinnen", Melliland Textilberichte 4/1969, Seite 384)[Mayer, "Calculation of propellant Tension and Heat Transfer on Filaments Longitudinally Blown Against", *Chem-Ing.-Technik.* Vol. 42, 1970, No. 6, p. 401; Hamana et al "The Development of Filament Generation during Filament Spinning", *Melliland Textile Reports,* 4/1969, p. 384] to define the resistance coefficient c of a moving filament in static air according to the equation $$c = \frac{2g\tau}{\gamma w^2} \tag{1}$$

with $$\tau = \frac{dp_f}{d\pi dx} \tag{2}$$

where $\tau$ is the wall propellant tension at a filament element of a length dx, $\gamma = 1/v$ the specific weight of the air and w the air speed (filament) and d denotes the filament diameter.

The resistance coefficient c is not a constant; it changes according to the equation $$c = a \cdot Re^{-b} \tag{3}$$

with the Reynolds number Re. The constants a and b shown in the above equation differ depending on the author and in Mayer are a=0.14; b=0.726; in Hamana a=0.37; b=0.61 and in Thompson a=1.13; b=0.60.

With the Reynolds number $$Re = \frac{w \cdot d}{v} = \frac{w \cdot d}{\eta \cdot g \cdot v} \tag{4}$$

where $\upsilon$ is the kinematic viscosity and $\eta$ the dynamic viscosity, when equating the above equations (1) and (3) with the constant of Hamana, the result for the filament draw-off force is:

$$\frac{dp_f}{dx} = .2385 \left(\frac{d}{v}\right)^{.39} \cdot w^{1.39} \cdot \eta^{.61} \; kp/m \tag{5}$$

in the above should be inserted: d in m; v in $m^3/kg$; w in m/s and $\eta$ in kg $s/m^2$.

Based on the above equation (6) the following now results in general for the filament draw-off force:

$$p_f = \frac{w^{(2-b)}\,\eta^b}{v^{(1-b)}} \quad (6)$$

where in accordance with the calculation method of Hamana the value 0.61 and according to Hayer the value 0.726 should be inserted for b. In a comparison between adiabatic and isothermal line performed according to both methods of calculation (Hamana and Mayer), the values for the critical state at the slot nozzle exit are to be inserted for d, v and $\eta$. In the following the corresponding quantities for the adiabatic line and, in parentheses, for the isothermal line are stated: $w_k$=342.9 (313.0) m/s; $v_k$=0.855 (0.712) $m^3$/kg; $T_k$=293 (244) K; $\eta$=1.855.10 ($1.598 \cdot 10^{-6}$) kg s/$m^2$.

According to Hamana: $p_f$=1.133 (0.978) applies, and according to Mayer: $p_f$=0.1222 (0.1027).

As a result of this comparison according to both calculation methods it should be noted that the adiabatically operated slot nozzle generates a filament draw-off force higher by approximately 15%. In this lies an important advantage of the novel process, because the cited result means, drawing the reverse conclusion, that less energy is needed to achieve a certain filament draw-off force with the adiabatic process than with the isothermal process, which makes possible a considerable energy savings.

The fact that the air compressor as well as the slot nozzles are operated adiabatically or polytropically leads to the other advantage that no condensation moisture is created as is in the isothermal process and that therefore the sticking together of the warps can be avoided.

It had been already noted above that the admission pressure of the slot nozzles 16 is set somewhat higher than the critical pressure, so that the expansion of the air stream occuring because of this at the exit slots 26 of the slot nozzles 16 lifts the warps slightly away from the nozzle wall 18.

However, the admission pressure is not set too high, but is kept as low as possible within the scope of practicality, since the ratio of energy expenditure to filament draw-off power is more advantageous at low nozzle admission pressure. The lower limit of the admission pressure occurs when the relative speed between the filaments 12 and the air is so small that the filament draw-off force decreases out of proportion. A preferred value of the ratio of energy expenditure to filament draw-off force lies between 1.1 and 5 bar.

The detailed construction of a slot nozzle 16 used with the novel process and in the novel apparatus can be seen from FIGS. 3 to 7. Each slot nozzle 16 has a front chamber 34 and a rear chamber 36, which are connected with each other via a slit 42 of 1.5 mm. The front chamber 34 leads via a slit 38 (1.5 mm) into the exit slot 26. Ribs 40 in the form of a flow grating are disposed in the feed to the exit slot 26 in order to align the turbulent flow ahead of the exit slot 26. In the front section of the slot nozzle 16, bores 20 for cooling by means of cooling water or the like are provided, as can be seen especially clearly in FIG. 3 Within the rear chamber 36 a supply tube 44 extends in each slot nozzle 16, the two outer ends of which are connected to the compressor, not shown, i.e. supply of air comes from the direction of both ends of the supply tube 44.

The wall of the supply tube 44 extends near the upper and lower wall of the rear chamber 36, forming a slit 48 and 50 of approximately 1.5 mm each.

The supply tube 44 has a slot 46 from which the air from the compressor can exit into the rear chamber 36. The slot 46 extends along the entire length of the rear chamber 36 and has different slot widths over this length, as schematically shown in FIG. 4. For the purpose of averaging out over the entire width of the slot nozzle, the width of the slot has been changed symmetrically to the center of the tube (seen in a longitudinal direction). In the center of the tube the slot width S is 2 mm and it is discretely enlarged up to 3 and 4 mm in the direction to the tube ends. In actuality the diameter spread is equalized, so that the slot 46 widens continuously from 2 mm at the center to 4 mm at the ends.

The innovation associated with the invention is not limited to the exemplary embodiment described, many modification are possible within the scope of the invention. The main object always is the idea to guide the filaments 12 not through tubes, but along a flat wall surface, namely the nozzle wall 18, while achieving the filament draw-off force, in order to avoid tangling of the several filaments 12 and thereby to guarantee a uniform distribution of weight over the surface of the irregular non-woven fabric sheets to be produced.

In connection with FIG. 3, it should additionally be pointed out that in actuality a slightly tapering nozzle lip is probably hard to manufacture with machine tools. To remedy this, a glued-on wiper sheet 54 is used in a practical embodiment of the invention which meets in a simple and precise manner the requirements demanded.

What is claimed is:

1. A process for the production of irregular non-woven material sheets having a uniform distribution of weight over their surfaces by avoiding filament tangling comprising the steps of:

generating gaseous propellant having a relatively high temperature with a compressor means;

drawing said filaments off spinnerets in the form of a warp with said gaseous propellant, said gaseous propellant exiting a plurality of cooled slot nozzles stacked on top of each other on a nozzle wall, said slot nozzles and compressor means operating polytropically such that said gaseous propellant expands and decreases in pressure so that said gaseous propellant exiting said slot nozzles is at substantially ambient air temperature; and depositing said filaments on said substrate.

2. A process in accordance with claim 1, wherein the gaseous propellant downwardly exits from the slot nozzles at an angle of approximately 15° or less to vertical with respect to the nozzle wall.

3. A process in accordance with claim 1, wherein the warp, after having passed the nozzle wall is deposited by means of a flip-flop cross winding on the substrate.

4. A process in accordance with claim 1, wherein the ratio of admission pressure of the slot nozzles to ambient air pressure is set larger than a Laval pressure ratio.

5. A process in accordance with claim 4, wherein the warp is kept at a distance from the nozzle wall by means of the expansion of the gaseous propellant at the exit of the slot nozzles.

6. A process in accordance with claim 1, wherein the filaments exiting the spinnerets are cooled to room temperature by a transverse air stream.

7. A process according to claim 1, wherein said relatively high temperature of said gaseous propellant is above 350° K.

* * * * *